US005244366A

United States Patent [19]

Delmotte

[11] Patent Number: 5,244,366

[45] Date of Patent: Sep. 14, 1993

[54] ROLLING PISTON COMPRESSOR, AND A CYLINDER THEREFOR

[75] Inventor: Scott Delmotte, Tioga, Pa.

[73] Assignee: Dresser-Rand Company, Corning, N.Y.

[21] Appl. No.: 32,592

[22] Filed: Mar. 17, 1993

[51] Int. Cl.[5] ..... F01C 1/02

[52] U.S. Cl. ..... 418/63; 418/248

[58] Field of Search ..... 418/63, 248, 64, 65, 418/66, 249, 251, 244

[56] References Cited

U.S. PATENT DOCUMENTS 2,395,065 2/1946 Rataiczak ..... 418/63

5,102,318 4/1992 Yen ..... 418/247

*Primary Examiner*—Richard A. Bertsch

*Assistant Examiner*—Charles G. Freay

*Attorney, Agent, or Firm*—Bernard J. Murphy

[57] ABSTRACT

The cylinder, having a central axis, has its bore for the rolling piston formed therein perpendicular to the axis. Too, the slot for the sliding vane is traverse the axis, and opens onto the piston bore. A channel formed through the cylinder, at one side of the slot, and another channel formed through the cylinder at the other side of the slot, provide for the admittance and discharge of intake gas and compressed, discharge gas, respectively. The compressor is built up from such a cylinder, with a piston-driving crankshaft, a biased, sliding vane, and bearing-supporting and lubrication-accommodating end cover assemblies.

11 Claims, 2 Drawing Sheets

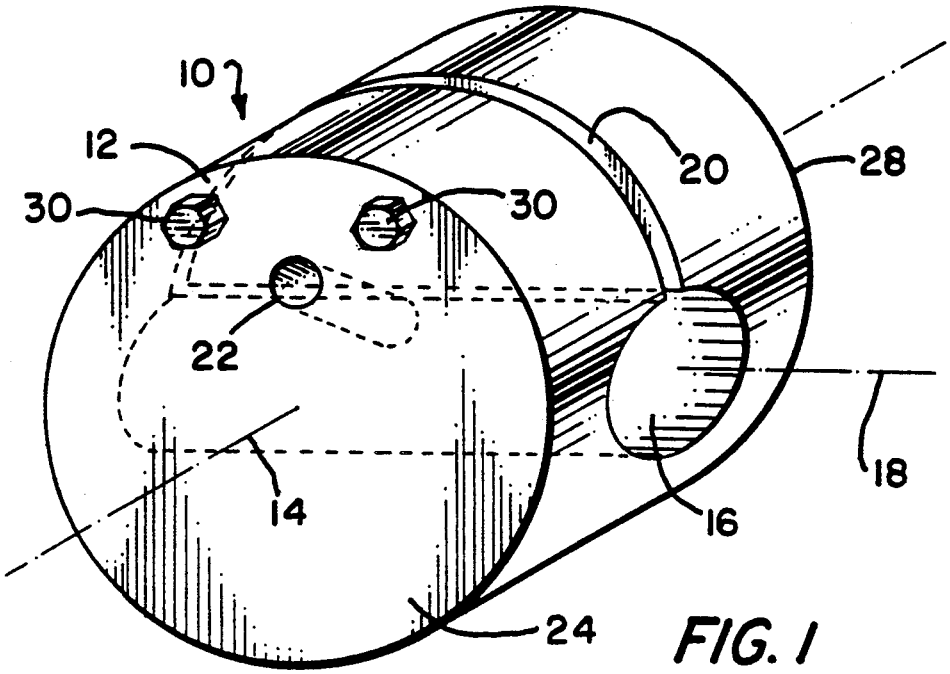
FIG. 1
FIG. 2
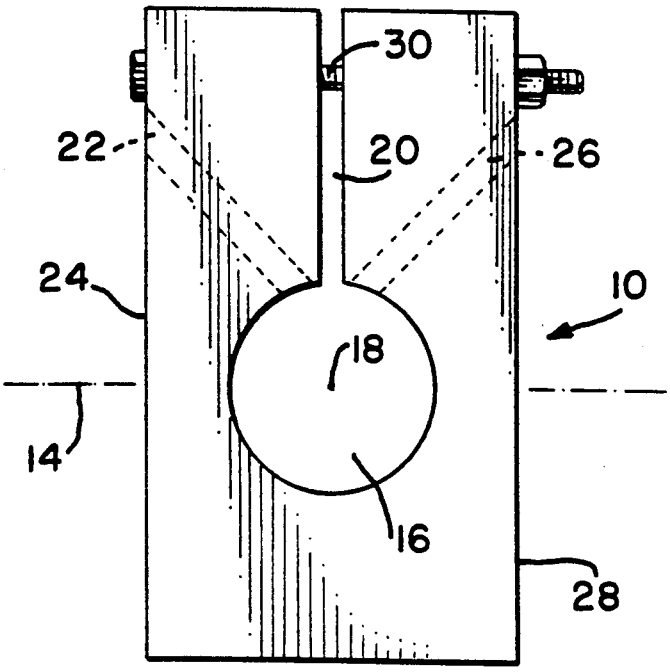

ROLLING PISTON COMPRESSOR, AND A CYLINDER THEREFOR

BACKGROUND OF THE INVENTION

This invention pertains to rolling piston compressors, and to cylinders therefor, and in particular to such a compressor and cylinder in which the piston bore is transverse to the central axis of the cylinder.

Commonly, rolling piston compressors, and the cylinders thereof, have a piston bore which occupies the central axis thereof. Such require meticulous facing of the end covers with the side walls of the cylinder, and special procedures to align the main bearings with the cylinder bore.

It is an object of this invention to set forth a radical cylinder for a rolling piston compressor, and a correspondingly radical, rolling piston compressor incorporating such a cylinder, which is not met with the aforesaid facing and alignment requirements.

Particularly, it is an object of this invention to set forth a cylinder, for a rolling piston compressor, comprising a cylindrical body having a central axis, wherein said body has a bore formed therethrough perpendicular to said axis; and said body further has a slot formed therein transverse to said axis.

It is additionally an object of this invention to disclose a rolling piston compressor comprising a circular cylinder having a central axis; wherein said cylinder has a piston bore formed therein perpendicular to said axis; said cylinder further has a slot formed therein transverse to said axis; a crankshaft journalled in said bore, having a crank formed thereon; a rolling piston engaged with said crank; a slidable vane in said slot and engaged with said piston; said cylinder has outer, parallel wall surfaces; and means formed in said cylinder, in communication with said bore and opening onto said surfaces, for admitting gas into said bore and for discharging compressed gas therefrom.

Further objects of this invention, as well as the novel features thereof, will be apparent by reference to the following description taken in conjunction with the accompanying figures, in which:

BRIEF DESCRIPTION OF THE DRAWINGS

FIG. 1 is a perspective view of the novel cylinder, according to an embodiment thereof;

FIG. 2 is a side, elevational view of the FIG. 1 cylinder;

DETAILED DESCRIPTION OF THE DRAWINGS

Figure 4:
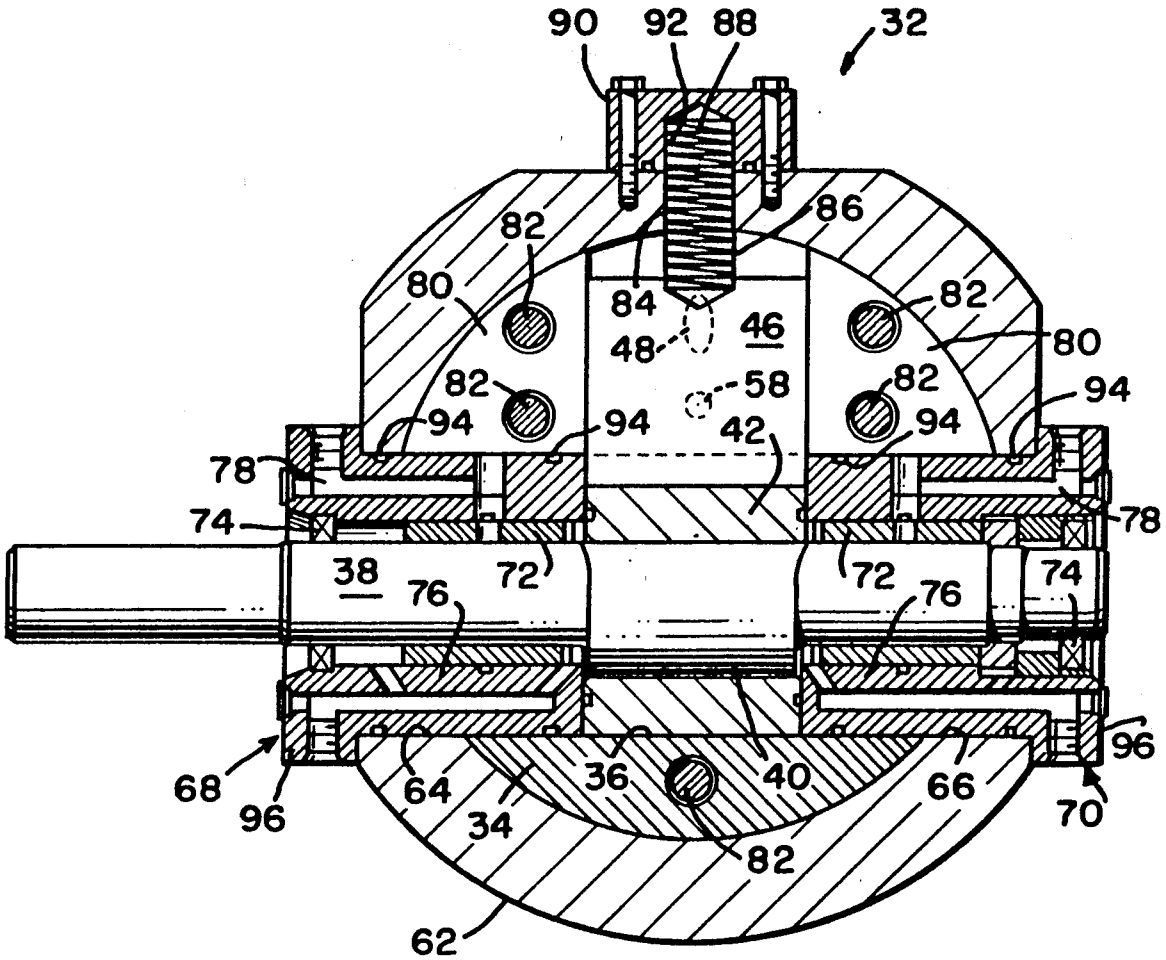
FIG. 4 is is another, vertical, cross-sectional view of the compressor of FIG. 3, the view taken along the axis of the crankshaft.

As shown in FIGS. 1 and 2, the novel cylinder 10 comprises a cylindrical body 12 having a central axis 14. The body 12 has a bore 16 formed therein perpendicular to the axis 14, having its own axis 18. Too, the body has a slot 20 formed therein, also extending perpendicular or transverse to the axis 14. The slot 20 extends from the outer, top surface of the cylinder to, and opens onto, the bore 16. Additionally, the cylinder has a first passageway 22 which extends from one cylinder wall surface 24 to said bore 16, and opens onto the bore 16 at one side of the slot 20, and a second passageway 26 which extends from the bore 16 to the opposite cylinder wall surface 28, and opens onto the bore 16 at the opposite side of the slot 20. Bolts 30 are arranged through the cylinder, and across the slot 20.

The slot 20 is provided to accommodate a sliding vane therewithin, and the bore 16 is formed to receive therein a crankshaft and rolling piston, toward the formation of a rolling piston compressor.

Figure 3:
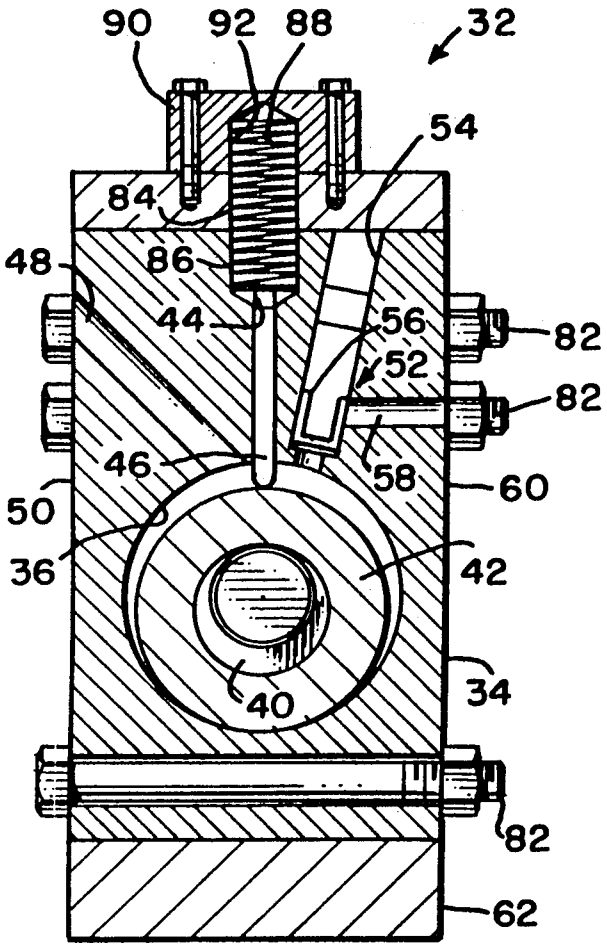
FIG. 3 is vertical, cross-section view of the novel compressor, incorporating a cylinder like that of FIGS. 1 and 2, according to an embodiment of the invention.

Such a rolling piston compressor 32 is depicted in FIGS. 3 and 4. The same has a cylinder 34 with a bore 36 in traverse thereof. A crankshaft 38, having a single crank 40 thereon, is arranged in the bore 36. The crank 40 mounts a rolling piston 42 thereabout. The cylinder 34 has a slot 44 formed therein, the same having a sliding vane 46 set therein. The cylinder 34 has an inlet passageway 48 formed therein, the same extending from outer, cylinder wall surface 50 to, and onto the bore 36, at one side of the slot 44. An outlet passageway arrangement 52 is formed at the other side of the slot 44; an inclined passageway 54 of the arrangement 52 opens onto the bore 36 and onto the top surface of the cylinder 34. Passageway 54 confines a check valve 56 therein. A horizontal passageway 58 opens onto passageway 54, confronting the check valve 56 thereat, and externally onto the opposite, cylinder wall surface 60. The cylinder 34 is confined, thereabout, by a sealing ring 62. The ring 62 has oppositely disposed apertures 64 and 66 which, dimensionally, correspond to the dimension of the bore 36. The apertures receive therein bore end cover assemblies 68 and 70, respectively. The assemblies 68 and 70 support sleeve bearings 72 therein, for the journalling of the crankshaft 38, and fluid seals 74. The assemblies 68 and 70 comprise tubular components 76 which confine the bearings 72 therein, and which are channeled with lubrication passageways 78 for conducting lubricant to the bearings 72 and crankshaft 38. Arranged within the ring 62, in the slot 44, and to opposite sides of the vane 46, are vane spacers 80. Rigidizing bolts 82 are passed through the cylinder 34, at the bottom below the bore 36, and across the slot 44, astride the vane 46, and in penetration of the vane spacers 80, at the upper portion of the compressor 32.

The sealing ring 62, at the top, has a hole 84 formed therethrough which directly aligns with a corresponding recess 86 formed at the top of the cylinder 34. The hole 84 and recess 86 nest a compression spring 88 therein, and the spring biases the vane 46 into fast engagement with the piston 42. A cap 90 is fastened to the top of the sealing ring 62, and has a corresponding recess 92, which aligns with the aforesaid recess 86 and hole 84, to capture the spring 88 therein.

It sill be appreciated that, as the vane 46 experiences wear along the parallel sides thereof, the four, upper rigidizing bolts 82 can be torqued, slightly, to take up any undue spacing in the slot 44. Also, there's little need for the tubular components 76 to be precisely machined to match the apertures 64 and 66; the components 76 have considerable length, and accommodate a plurality of seals 94 thereabout and therealong. Additionally, the components 76 have outermost, circular flanges 96, in which some of the passageways 78 are formed, and offer annular shoulders, interfacing the sides of the sealing ring 62, in which to emplace sealing gaskets if desired.

While I have described my invention in connection with specific embodiments thereof, it is to be clearly understood that this is done only by way of example, and not as a limitation to the scope of the invention as set forth in the objects thereof, and in the appended claims.

I claim:

1. A rolling piston compressor, comprising:

a circular cylinder having a central axis; wherein said cylinder has a piston bore formed therein perpendicular to said axis;

said cylinder further has a slot formed therein transverse to said axis;

a crankshaft journalled in said bore, having a crank formed thereon;

a rolling piston engaged with said crank;

a slidable vane in said slot and engaged with said piston;

said cylinder has outer, parallel wall surfaces; and means formed in said cylinder, in communication with said bore and opening onto said surfaces, for admitting gas into said bore and for discharging compressed gas therefrom.

2. A rolling piston compressor, according to claim 1, wherein:

said cylinder has means therewithin, and engaging said vane, biasing said vane in engagement with said piston.

3. A rolling piston compressor, according to claim 1, wherein:

said cylinder has a cap fixed thereto;

said cap has a recess formed therein; and a compression spring is set in said recess, and has an end thereof engaged with an outer end of said vane.

4. A rolling piston compressor, according to claim 1, wherein:

said gas admitting and discharging means comprises a channel for admitting gas into said bore, which opens onto one of said surfaces, and a passageway for discharging compressed gas from said bore which opens onto the other of said surfaces.

5. A rolling piston compressor, according to claim 4, wherein:

said passage for discharging compressed gas has a discharge valve assembly therein.

6. A rolling piston compressor, according to claim 1, further including:

a sealing ring; and wherein said cylinder is confined within said sealing ring.

7. A cylinder, for a rolling piston compressor, comprising:

a cylindrical body having a central axis, wherein said body has a bore formed therethrough perpendicular to said axis; and said body further has a slot formed therein transverse to said axis.

8. A cylinder, according to claim 7, wherein:

said body has outer, parallel wall surfaces;

first means formed in said cylinder for communicating said bore with one of said wall surfaces; and second means formed in said cylinder for communicating said bore with the other of said wall surfaces.

9. A cylinder, according to claim 7, wherein:

said slot extends between an outer surface of said cylinder and said bore.

10. A cylinder, according to claim 7, wherein:

said slot opens onto said bore.

11. A cylinder, according to claim 8, wherein:

said first means open onto said bore at one side of said slot, and said second means opens onto said bore at the opposite side of said slot.

* * * * *